US006871507B1

(12) United States Patent
Goldsmith

(10) Patent No.: US 6,871,507 B1
(45) Date of Patent: Mar. 29, 2005

(54) EXPANSION VALVE METERED CONTROL OF WATER MISTERS

(75) Inventor: Aaron Goldsmith, 24806 Alexandra Ct., Calabasas, CA (US) 91302

(73) Assignee: Aaron Goldsmith, Calabasas, CA (US)

( * ) Notice: Subject to any disclaimer, the term of this patent is extended or adjusted under 35 U.S.C. 154(b) by 0 days.

(21) Appl. No.: 10/741,062

(22) Filed: Dec. 19, 2003

(51) Int. Cl.[7] ..... F25B 39/04; F28D 3/00; F28D 5/00

(52) U.S. Cl. ..... 62/183; 62/171; 62/305

(58) Field of Search ..... 62/183, 171, 305, 62/304, 285, 89, 91, 121, 506; 137/625.43, 79; 165/110

(56) References Cited

U.S. PATENT DOCUMENTS 3,872,684 A * 3/1975 Scott ..... 62/181

FOREIGN PATENT DOCUMENTS

JP 2000018769 A * 1/2000 ..... F25B/39/04

* cited by examiner

*Primary Examiner*—Chen Wen Jiang

(57) ABSTRACT

An apparatus is described for applying a fine mist of water to an air conditioner condenser coil for increasing the heat transfer thereof. A water source under normal utility pressure is tapped for flow into a reduced diameter tube supplying the apparatus. Said tube water is filtered and electrolysis protected by a magnesium element affixed to the tube and to the air conditioner structure. A metering valve used exclusively for metering small flows of liquid Freon-type refrigerant, is modified and adapted for exclusive use in metering water to the misters. It is conjoined with a temperature sensor bulb filled with expandable refrigerator coolant as a control initiator and which communicates with said valve via a sealed capillary tube to a chamber and diaphragm means. As the sensor bulb is located at the heat exchanger coil, this expansion valve meters water flow control in accordance with the temperature of the heat exchanger, without the use of electricity or dependence on fan power.

2 Claims, 3 Drawing Sheets

EXPANSION VALVE METERED CONTROL OF WATER MISTERS

| CROSS-REFERENCE TO RELATED APPLICATIONS | |
|---|---|
| 1. Ellis. May 1981 | 4,266,406 |
| 2. Welker et al. August 1987 | 4,685,308 |
| 3. Marine. February 1994 | 5,285,651 |
| 4. Middleton et al. February 1997 | 5,605,052 |
| 5. Phelps, et al. December 1997 | 5,701,748 |
| 6. Arledge. July 2001 | 6,253,565 |
| 7. Pringle May 2002 | 6,381,980 |
| 8. Siewert June 1965 | 3,188,829 |
| 9. Di Tucci October 1971 | 3,613,392 |
| 10. Bastle June 1991 | 5,026,022 |

STATEMENT REGARDING FEDERAL SPONSORED RESEARCH OR DEVELOPMENT

"Not Applicable"

INCORPORATION-BY-REFERENCE OF MATERIAL SUBMITTED ON A COMPACT DISK

"Not Applicable"

REFERENCE TO A MICROFICHE APPENDIX

"Not applicable"

BACKGROUND OF THE INVENTION

This invention relates to an externally mounted array of misting water nozzles for increasing the cooling efficiency of an air conditioner. Heat transfer between a fluid conductor or heat exchange member and the atmosphere can be improved by evaporating water or other liquids in contact with the surface of the heat exchange member. More compact air conditioners generally cool the refrigerant with moving air only, as the use of water in liquid form, such as in water towers as an example, create problems with cost, bulk and managing water flow, etc. Water in mist form will evaporate more quickly than will a liquid surface and requires less water to be introduced to the heat exchanger for optimum results. The finer the mist, the better are the results possible.

With reference to prior art, U.S. Pat. No. 3,613,392 (Di Tucci) teaches an expansion bulb, actuating an electric solenoid switch, operating in a fully on or off manner and causing the valve also to either open or close fully (not metering) in controlling water flow through a supply conduit to sprayer nozzles when the ambient (outside) air rises to a critical level. The expanding Freon-type vapor within the bulb, triggers the electric solenoid in this all-or-none fashion without metering, when said vapor reaches a critical pressure level corresponding with the critical outside temperature. Neither have Morgan and Siewert, Phelps and all others of record, taken advantage of the gradation capabilities of expansion valves in cooling air conditioner condensers with water. It is further submitted that metering valves in use in the air conditioner field for controlling Freon-type refrigerants also have never been used for controlling water flow.

An expansion bulb per se, can operate in an all-or-none way or in a gradated manner, if properly integrated to a valve of appropriate design such as the metering valve disclosed in this invention. Therefore the combination thereof, or integration of one into the other for metering control, becomes an object of this invention.

Another object of this invention is to adapt such expansion valves, designed for metering refrigerant fluids, for the specific purpose of metering water flow only.

It is a further object of this invention to provide means for automatic metering of a fine mist of water to the heat exchange portion of an air conditioner condenser in such a manner that a minimum volume of water is used in providing maximum heat transfer.

Another object of this invention is to provide means for automatic application of a minimum volume of water in the form of a fine mist to the heat exchange portion of an air conditioner condenser in accordance with the temperature of that heat exchange portion.

It is also an object of this invention to provide an apparatus which reduces and minimizes the cost of operation of an air conditioner system, by improving the efficiency of heat rejection at the heat exchanger when introducing a mist of water thereto.

Another object of this invention is to provide an automatic water distribution system with minimum complexity and high reliability at lower cost, by using components in a way not intended for such a purpose.

It is also an object to provide a system which by its simplicity can be readily added to an air conditioner by persons of average skill.

A further object is to provide corrosion resistance to the apparatus by sacrificial anode installation, using magnesium strip or rod.

Other objects and advantages of this invention reside in construction and usage in novel ways and the combination thereof, as will become more apparent from the following description.

SUMMARY OF THE INVENTION

An air conditioning system add-on consists of a water distribution system tapping off from a utility supply line of normal pressure and including a structure for distributing one or more misting heads, a magnesium electrolysis prevention entity, a line filter for incoming water, an integral metering valve and temperature sensor\flow control initiator unit, made suitable for fluid water metering rather than for the formerly intended fluid Freon refrigerant passage

DESCRIPTION OF THE PREFERRED EMBODIMENT

Figure 1:
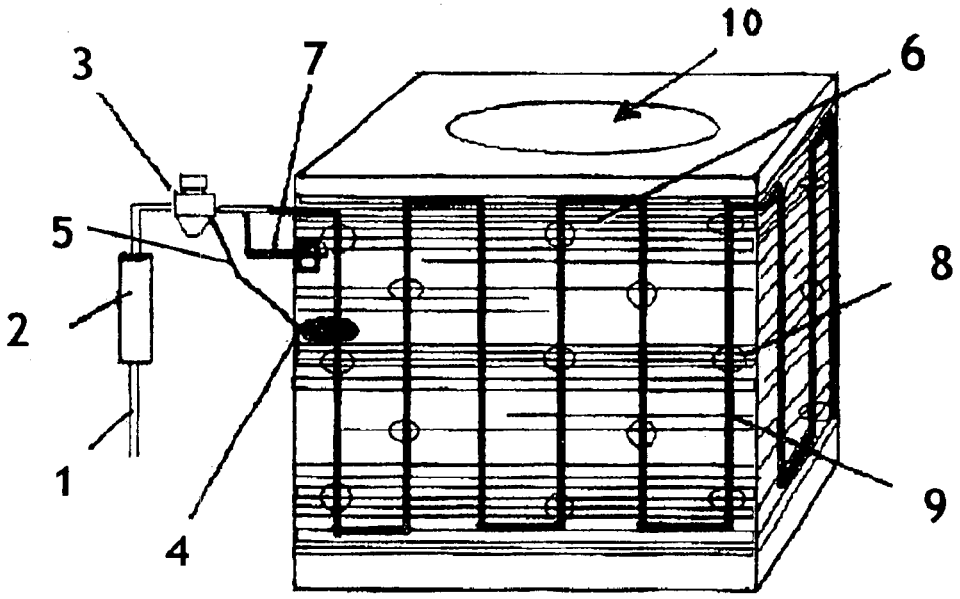
FIG. 1 is an oblique side view of a condenser of an air conditioner, showing the entities in a schematic arrangement around the condenser.

A condenser, 10 is shown in FIG. 1. A water source 1 of one-fourth to three eighths inch diameter copper tubing comes from tapping a utility source pipe of normal line pressure of fifty PSI. Tube 1 encounters a line filter 2, which removes particulates and sediments from the water before reaching expansion valve 3, covered in detail in FIGS. 2 and 3. Temperature sensing bulb 4, being a part of valve 3, communicates with said valve by means of capillary tube 5 and is affixed to condenser coil 6, or adjacent thereto. Expansion valve 3 occupies a position downstream from filter 2 and upstream from magnesium rod 7 which is affixed to tube 1 and condenser 10, acting as a sacrificial anode to all metallic structures subject to wetting by misters 8 in order to prevent corrosion. A plurality of said misters are individually attached to tube array 9 at various locations along the traverse of the individual tube sections according to need.

Figure 2:
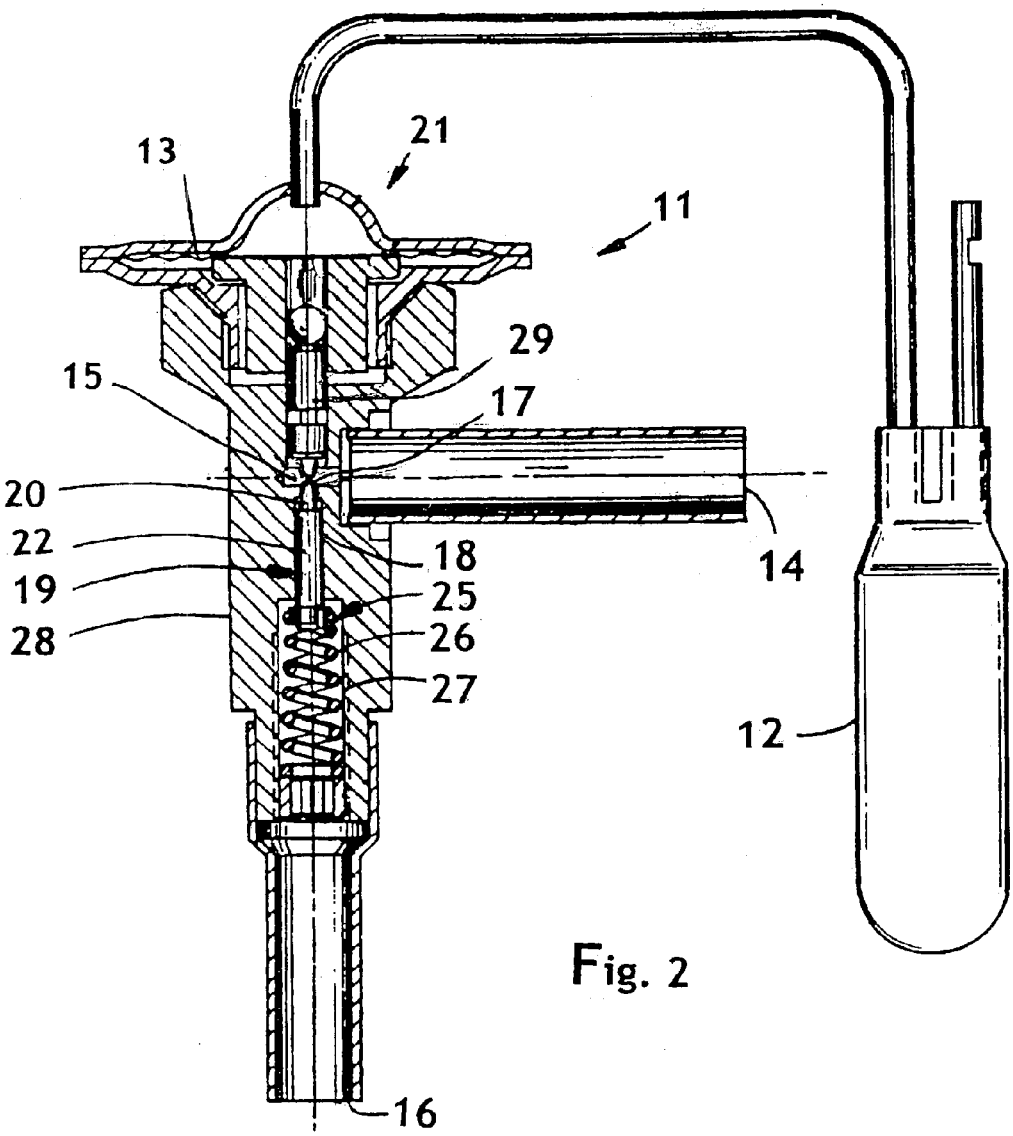
FIG. 2 is a lateral, mid-section view, showing a typical Freon expansion valve used in metering Freon in an air conditioning cycle, but adapted for metering water.

In FIG. 2, valve 11 is currently used exclusively as a metering valve for Freon-type refrigerants. As stated under "Background of Invention" heading, an application in which water has been metered instead of Freon in this valve design has never been specified by others up to the time of this petition, therefore this specification is being written to include the details as described here, but with a changed application to a significantly different, yet narrowly defined usage for the valve. Valve 11 is fused with temperature sensor bulb 12 and is adapted for metering water flow, rather than refrigerant flow. It includes a corrosion resistant (CR) body 28 with an on-center transverse inlet tube 14 and a reduced diameter concentric extension 15 transversely continuing through the center of said body and confluent through orifice 17 with outlet 16. Said orifice is of slightly smaller diameter than that of 15, which it penetrates and is concentric with cylindrical chamber 18, a concentric CR metering pin 19 containing a needle head portion 20 is movable into said orifice with its cylindrical body portion 22 within chamber 18. A CR power element 21 with CR diaphragm 13, is fused with bulb 12 and responds to Freon vapor expansion within said bulb from temperature rise therein and moves pressure pin 29 downward against head 20 of pin 19, moving said head and pin away from element 21 and against compression return spring 26 housed within outlet chamber 27, thus enabling water flow to exit from extension 15 through orifice 17 and outlet 16. The outer wall of the cylindrical body portion 22 of the metering pin 19 is disposed from the inner wall of the cylindrical chamber 18 to form an accurately sized, yet very small annular space for water passage. Said valve then enables accurate metering control of said water at low flow rates through the valve. A slightly higher maximum flow rate would demand increasing said annular space by adjusting diameter of body 22 or chamber 18 and taper of needle head 20.

Figure 3:
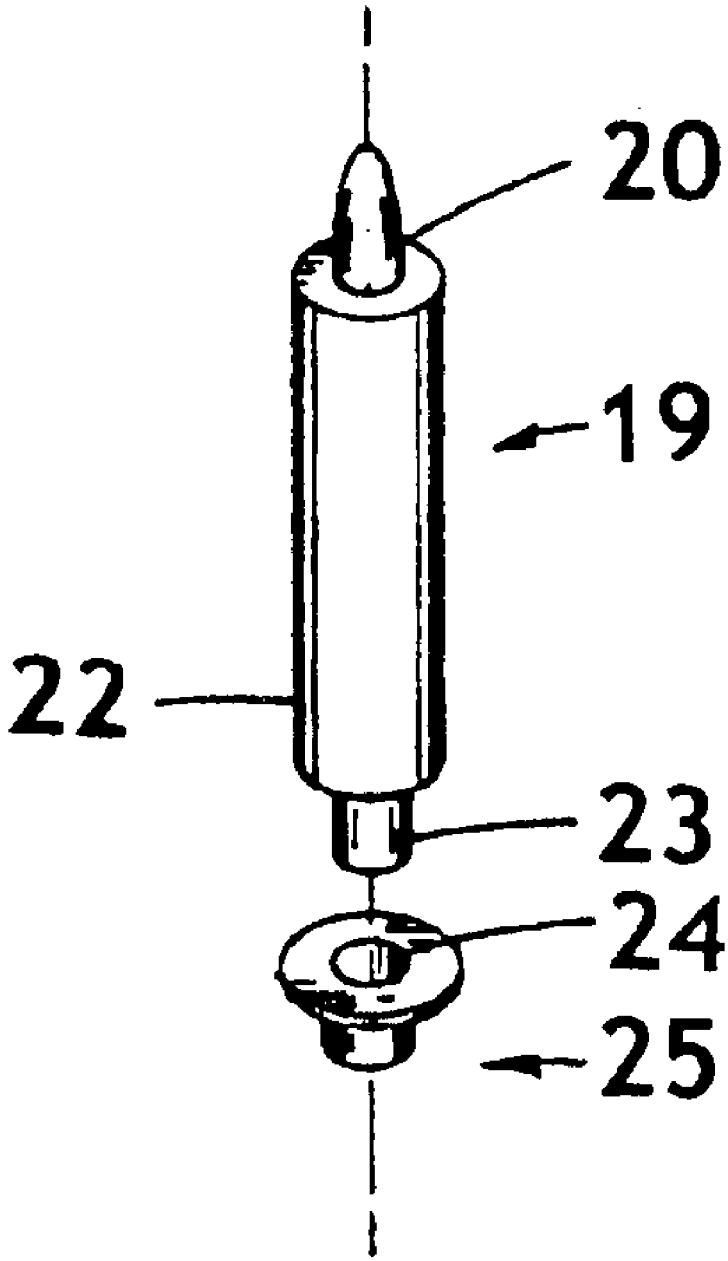
FIG. 3 is an exploded lateral oblique view of the metering pin of the expansion valve of FIG. 2.

In FIG. 3, metering pin 19 includes cylindrical body 22 with needle head portion 20 at the first end, thereof and a reduced diameter cylindrical shoulder 23 at the second end, to slip into hole 24 of collar\retainer 25, which accepts the first end of compression spring 26 within outlet chamber 27 (shown in FIG. 2.).

Although the above description is the preferred one, other variations in detail may be implemented without altering the essence of this disclosure.

The invention having being thus described, the following is claimed:

1. An apparatus for minimizing the cost of operation of an air conditioner by applying a controlled minimum volume of fine water mist onto a heat exchange condenser with refrigerant-containing coils which is a part of the air conditioner, the condenser including spaced water conduits affixed thereupon, said apparatus comprising a plurality of spaced water mister nozzles for spraying a fine mist upon said coils and the moving air flow surrounding them, a water supply line connected to said water conduits and said misters, a sacrificial anode containing magnesium strip or bar connected to the water source and to structures exposed to Galvanic electrolysis when wetted, a particulate filter between the water supply and the expansion valve unit, a non-electrical, metering expansion valve dedicated for use with water, a temperature sensor bulb, intimately associated with said valve as a fused structure, operating against a moveable metal diaphragm therein, said temperature sensing portion positioned so as to sense the temperature conditions of said condenser coils and transmitting control by vapor pressure means to said diaphragm in said valve through capillary tube means.

2. The apparatus in claim 1, with said water control valve being an integration of a Freon vapor expansion type sensor\controller and a metering valve portion thereof, formerly designed for metering liquid Freon-type refrigerants only, but adapted with means for dimensional changes and corrosion resistant materials for specifically metering water.

* * * * *